United States Patent [19]

Brownfield

[11] 4,240,628

[45] Dec. 23, 1980

[54] MANIPULATIVE SKILL GAME

[76] Inventor: Charles H. Brownfield, 4116B Royce Dr., Alexandria, La. 71301

[21] Appl. No.: 76,129

[22] Filed: Sep. 17, 1979

[51] Int. Cl.[3] ..... A63F 7/38

[52] U.S. Cl. ..... 273/1 R; 273/110

[58] Field of Search ..... 273/1 R, 1 E, 1 M, 109, 273/115, 110, 116, 113; 46/43

[56] References Cited

U.S. PATENT DOCUMENTS

| | | | |
|---|---|---|---|
| 3,333,851 | 8/1967 | Rosen | 46/43 X |
| 3,399,894 | 9/1968 | Smith | 46/43 X |

FOREIGN PATENT DOCUMENTS

| | | | |
|---|---|---|---|
| 1056493 | 10/1953 | France | 273/110 |
| 1170296 | 9/1958 | France | 273/110 |
| 1230557 | 4/1960 | France | 273/110 |
| 653181 | 2/1963 | Italy | 273/110 |

OTHER PUBLICATIONS

Playthings Magazine 3-1954 p. 682 Tarrson's "3-in-1" puzzle ball.

*Primary Examiner*—Paul E. Shapiro
*Attorney, Agent, or Firm*—Roy, Kiesel, Patterson & McKay

[57] ABSTRACT

A skill game is provided having multi-levels of plates 360° pivotedly mounted on a support axis and contained in an enclosure assembly wherein each plate is provided with an opening large enough for a ball to pass through, two manipulating rods are attached to each plate and each rod having an arm member extending outside the enclosure assembly, and the enclosure assembly having an opening for the ball to enter and be placed in the top plate.

6 Claims, 4 Drawing Figures

2
8
18
19
20
21
22
23
3
4
5
7
7F
3F
3E
3D
3C
3B
3A
11
9
6
7A
25
31
10A
28
29
30
10
10B
32
24
26
27

MANIPULATIVE SKILL GAME

BACKGROUND OF THE INVENTION

1. Field of the Invention

This invention relates generally to amusement devices and, more particularly, to hand manipulated games.

2. Prior Art

There are numerous games which employ manipulative skill to move an object from one position to another. Examples of such games can be seen in Hutchison U.S. Pat. No. 1,826,215, issued Oct. 6, 1931, and entitled "Game", Schigas U.S. Pat. No. 2,772,883 issued Dec. 4, 1956, and entitled "Tilting Game Board", and Goldfarb, et al U.S. Pat. No. 3,934,881, issued Jan. 27, 1976, and entitled "Manipulative Skill Game Apparatus Having Tiltable Platforms and Automatic Feeder Mechanisms". However, none of these games employ the same finesse of hand-eye coordination employed by this invention nor are they designed to having simultaneous competitive play by two players.

SUMMARY OF THE INVENTION

Therefore, it is an object of this invention to provide a game that requires hand-eye coordination to operate.

Another object of this invention is to provide a game that can improve the hand-eye coordination of the player.

Still another object of this invention is to provide a game requiring hand-eye coordination that two players can simultaneously operate in competition with one another.

Other objects and advantages of this invention will become apparent from the ensuing descriptions of the invention.

Accordingly, a manipulative game is provided comprising multi-levels of plates connected separately from one another by first and second rods fixedly attached to each plate and aligned with respect to one another by a third rod to which each plate is pivotedly connected, each plate having at least one opening through which a ball can pass, each of the first and second rods being pivotedly attached at their lower ends to first and second extension arms, respectively, extending out from the plates a sufficient distance to be manipulated by a person's hand.

PREFERRED EMBODIMENTS OF THE INVENTION

Figure 1:
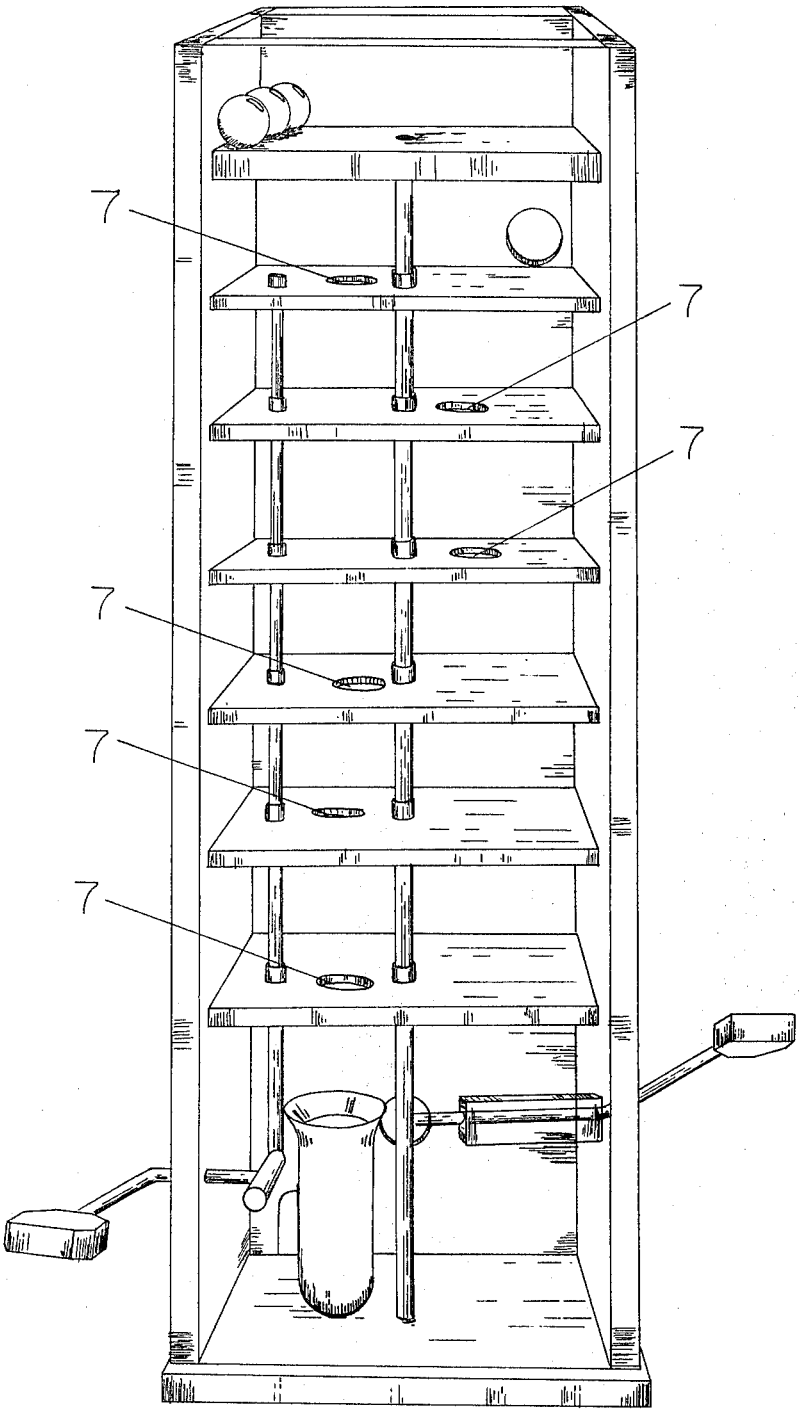
FIG. 1 is a perspective end view of one embodiment of this invention.
Figure 2:
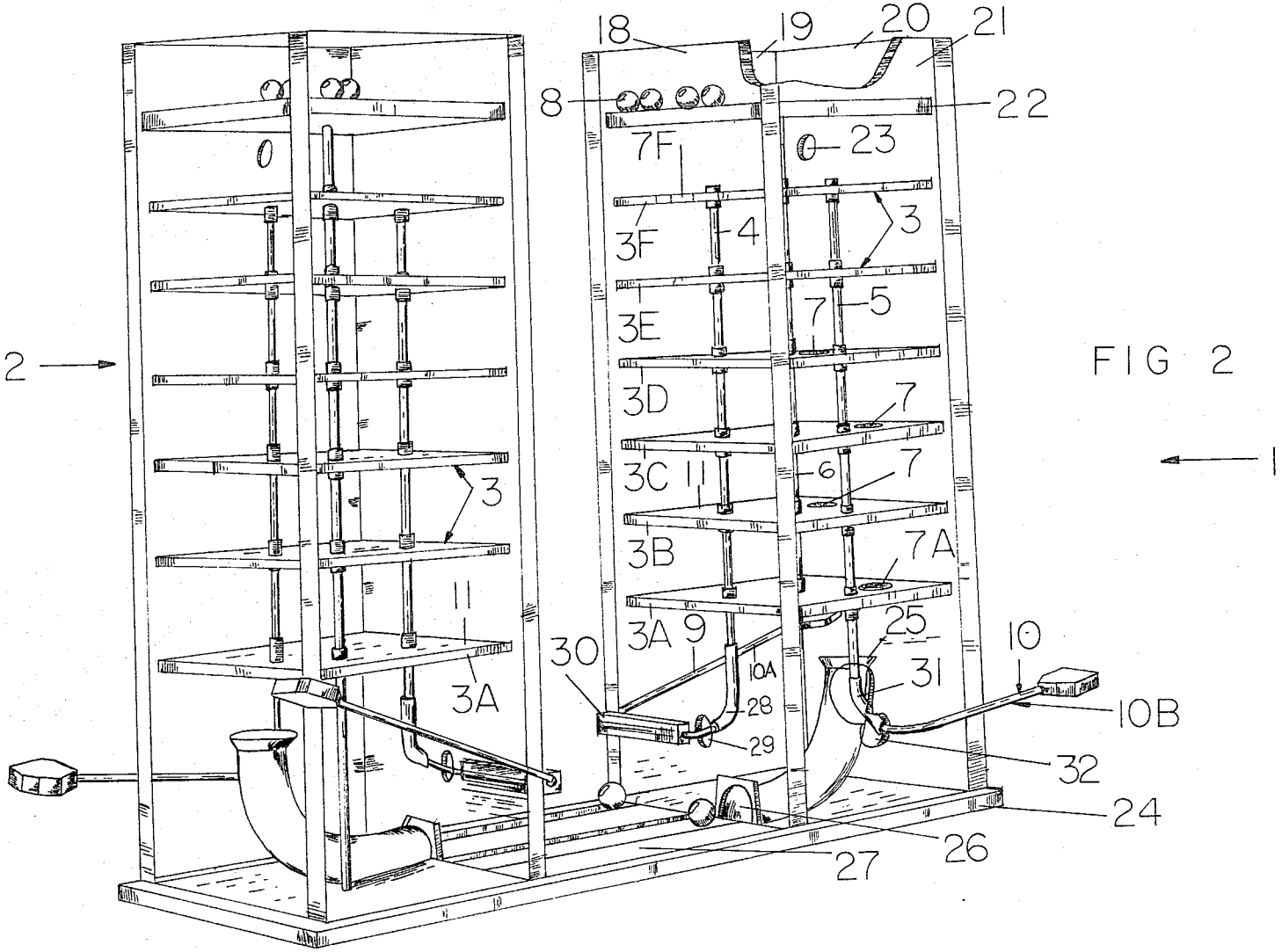
FIG. 2 is a perspective side cutaway view of one embodiment of this invention that can be played by two players simultaneously.

Without any intent to limit the invention, preferred embodiments are disclosed utilizing a two player game design as seen in FIGS. 1 and 2. In this embodiment, the invention comprises in basics two playing towers, denoted generally by the numerals 1 and 2, respectively, each tower having multi-levels of plates 3 connected separately from one another by rods 4 and 5 and aligned with respect to one another by rod 6 to which each plate 3 is pivotedly connected in a manner disclosed hereinbelow. Each plate 3 has at least one opening 7 through which a ball 8 can pass. Rods 4 and 5 extend downward below bottom plate 3A and are pivotedly attached at their lower ends to manipulative extension arms 9 and 10, respectively. Extension arms 9 and 10 extend outward from the plates 3 and tower 1 a sufficient distance to be manipulated by a person's hand.

Figure 3:
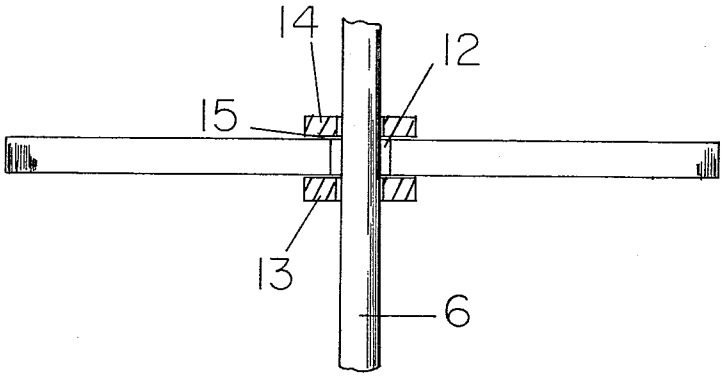
FIG. 3 is a cutaway view of one embodiment of this invention illustrating the plate pivotable connection to the aligning rod.

In a preferred feature, each plate 3 preferably has an upper flat surface 11 on which ball 8 can roll freely. In another preferred feature, each of the plate openings 7 will not be aligned with the opening in the adjacent plate. Still more preferably, rod 6 will be connected at the center of each plate 7 in a manner which allows each plate 3 to pivot up and down about rod 6. Turning now to FIG. 3, a preferred embodiment for the connection of plates 7 to the aligning rod 6 is illustrated. Plate 7 has a center opening 12 through which rod 6 extends. Immediately below plate 7 is a retaining ring 13 extending about rod 6 to position plate 3 at a set vertical height. Above plate 3 is a second retaining ring 14 which limits the pivotable movement of plate 3. The amount of pivotable movement can be controlled by the size of gap 15 existing between plate 3 and upper retaining ring 14.

Figure 4:
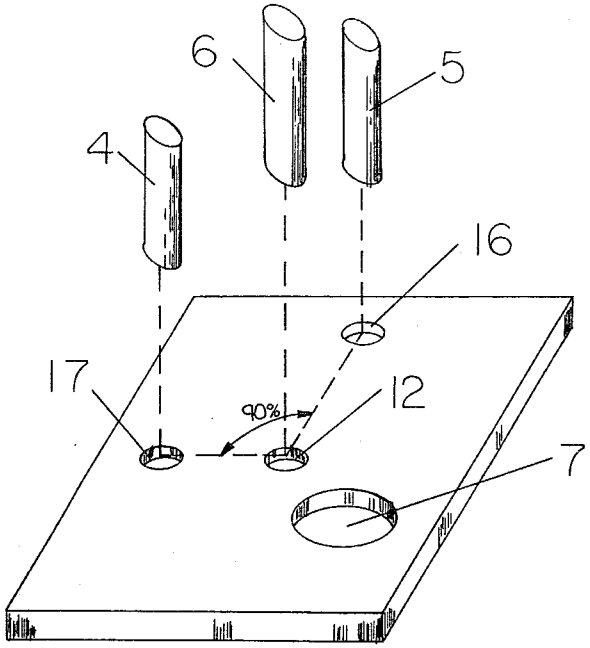
FIG. 4 is a perspective view of one embodiment of a plate used in this invention.

Each plate 3 is also provided with two other additional openings 16 and 17 through which manipulating rods 4 and 5 pass respectively. Preferably, openings 16 and 17 will not lie in a straight line with one another and with opening 12 but rather will form an angle of 90° or greater with opening 12 as shown in FIG. 4.

Tower 1 preferably comprises wall members 18, 19, 20 and 21 which surround plates 3 to prevent balls 8 from rolling off of plates 3. In another preferred feature, solid plate 22 is fixedly attached to aligning rod 6 above plates 3 for purposes of holding the supply of balls 8. In this embodiment, sidewall 20 is provided with wall opening 23 located above top plate 3F and is sufficient in diameter to allow ball 8 to pass through and onto the top of plate 3F. Walls 18, 19, 20 and 21 are connected at their lower ends to base member 24, which provides rigidity to the device. In another preferred embodiment, curved tubing 25 is attached to base 24 wherein one end of curved tubing 25 is positioned directly below opening 7A to receive ball 8 as it drops through. The opposite end of curved tubing 25 is attached to wall member 18 and is adjacent to wall opening 26 whereby ball 8 can exit out to base surface 27 where it can be retrieved.

Manipulating rod 4 is provided with a curved section 28 at its lower end so that it can extend through wall opening 29 and pivotedly attach to block 30, which may be connected on the exterior surface of wall 18. Also attached to block 30 in connection with rod 4 is manipulating extension arm 10A, which is parallel to wall 19 and extends beyond wall 20 as shown. In a similar manner, manipulating rod 5 is provided with a curved section 31 that extends through wall opening 32 and is pivotedly connected to block 32 and extension arm 10B as shown.

In operation, ball 8 is passed through opening 23 onto the top of plate 3F at which time the operator manipulates extension arms 10A and 10B to roll ball 8 toward opening 7F by moving extension arms 10A and 10B in an up and down motion, which motion results in a tilting of plate 3F. Once ball 8 falls through opening 7F, the process is continued on each succeeding plate 3E, 3D, 3C, 3B and 3A, until ball 8 falls through opening 7A and into curved tubing 25 and out and onto base surface 27. This process is then continued until each of the balls 8 have been similarly manipulated to base surface 27. If only one person is playing, the person can see how fast all of the balls can be manipulated to base plate 27 or if two players are playing, they can see who can get each of their balls 8 to base surface 27 first.

There are, of course, many obvious modifications and additions not specifically disclosed, but which are intended to fall within the scope of this invention as defined in the following claims.

What I claim is:

1. A game for manually manipulating balls from one position to another position comprising multi-levels of plates connected separately from one another by first and second manipulating rods fixedly attached to each plate and aligned with respect to one another by an aligning rod, to which each plate is pivotably connected, each plate having at least one opening through which a ball can pass, each of the first and second manipulating rods being pivotedly attached at their lower ends to first and second extension arms, respectively, extending out from said plates a sufficient distance to be manipulated by a person's hand.

2. A game according to claim 1 wherein each of said plates has a flat upper surface.

3. A game according to claim 1 wherein said first and second manipulating rods are attached to said plates to form an angle with said aligning rod ninety degrees or more.

4. A game according to claim 1 wherein said multi-levels of plates are surrounded at their perimeter by retaining walls positioned adjacent to said plates a distance less than the diameter of said balls.

5. A game according to claim 4 wherein a curved tubing is positioned having one end opening directly below the plate opening of the lowest positioned plate to receive said ball as it falls through said lowest plate opening and wherein said curved tubing extends through one of said retaining walls.

6. A game according to claim 1 wherein said aligning rod is provided with lower retaining rings positioned immediately below each plate and upper retaining rings positioned above each plate a distance sufficient to form a gap between said plates and said upper retaining rings.

* * * * *